US010695932B2

(12) United States Patent
Burk et al.

(10) Patent No.: US 10,695,932 B2
(45) Date of Patent: Jun. 30, 2020

(54) FOOD SLICING DEVICE WITH PRE-COOLING DEVICE

(71) Applicant: Weber Maschinenbau GmbH Breidenbach, Breidenbach (DE)

(72) Inventors: Alexander Burk, Braunfels (DE); Michael Knauf, Amöneburg (DE); Jochen Gerlach, Dautphetal (DE); Philip Kahl, Frankenberg (DE); Christian Nietsch, Dillenburg (DE); Andreas Runkel, Biedenkopf (DE); Thorsten Schneider, Weimar/Lahn (DE)

(73) Assignee: Weber Maschinenbau GmbH Breidenbach, Breidenbach (DE)

( * ) Notice: Subject to any disclaimer, the term of this patent is extended or adjusted under 35 U.S.C. 154(b) by 0 days.

(21) Appl. No.: 15/073,884

(22) Filed: Mar. 18, 2016

(65) Prior Publication Data

US 2016/0271822 A1 Sep. 22, 2016

(30) Foreign Application Priority Data

Mar. 19, 2015 (DE) ..... 10 2015 003 632

(51) Int. Cl.
*B26D 7/08* (2006.01)
*B26D 7/06* (2006.01)
(Continued)

(52) U.S. Cl.
CPC ..... *B26D 7/08* (2013.01); *B26D 5/00* (2013.01); *B26D 7/0616* (2013.01);
(Continued)

(58) Field of Classification Search
CPC ..... B26D 7/0608; B26D 7/0616; B26D 7/08; B26D 2003/285; B26D 2007/011
See application file for complete search history.

(56) References Cited

U.S. PATENT DOCUMENTS 3,708,995 A * 1/1973 Berg ..... F25D 3/11 62/63
3,927,588 A * 12/1975 Laderach ..... B26D 1/00 426/518
(Continued)

FOREIGN PATENT DOCUMENTS

DE 3018446 A1 * 11/1981 ..... B26D 7/01
DE 19860442 A1 12/1999
(Continued)

OTHER PUBLICATIONS

English Translation of W02006092310.*
Office Action from the EPO dated Jul. 27, 2016; 5 pages.
German Search Report dated Mar. 4, 2016; 12 pages.

*Primary Examiner* — Jennifer B Swinney
(74) *Attorney, Agent, or Firm* — Fitch, Even, Tabin, & Flannery LLP

(57) ABSTRACT

There is disclosed a food slicing device for slicing food products which has a pre-cooling device for cooling the food product before the slicing and a cutting device with a cutting blade. A temperature registration device for measuring the temperature of the food product and a control unit are provided, wherein the control unit is designed to calculate, based on the temperature measured by the temperature registration device, an instruction for the operation of the pre-cooling device, wherein the pre-cooling device is controllable depending on this instruction. The disclosure furthermore relates to a method for slicing a food product in which the food product is pre-cooled in a pre-cooling device, the temperature of the food product is measured after the pre-cooling and before or after the slicing of the food product, and the operation of the pre-cooling device is adjusted depending on the measured temperature level of the food product.

20 Claims, 3 Drawing Sheets

(51) Int. Cl.
*B26D 7/10* (2006.01)
*B26D 5/00* (2006.01)

(52) U.S. Cl.
CPC ..... *B26D 7/0625* (2013.01); *B26D 7/10* (2013.01); *B26D 7/0683* (2013.01); *B26D 2210/02* (2013.01)

(56) References Cited

U.S. PATENT DOCUMENTS 4,086,813 A * 5/1978 Meek ..... G01K 1/08 219/712
4,580,909 A * 4/1986 McIntosh ..... A47J 43/283 294/3
5,634,719 A * 6/1997 La Neve ..... G01K 1/146 116/216
5,746,063 A * 5/1998 Hall ..... B26D 1/00 62/3.2
6,007,859 A * 12/1999 Taylor ..... A23B 4/10 118/19
6,318,111 B1 11/2001 Murakami et al.
6,483,695 B1 * 11/2002 Hartstein ..... F25D 29/005 361/679.09
6,488,873 B1 12/2002 Bessemer et al.
2006/0150662 A1 * 7/2006 Lee ..... F25D 29/00 62/441
2008/0053124 A1 * 3/2008 Cho ..... A01N 1/02 62/207
2008/0250945 A1 * 10/2008 Seager ..... B26D 5/007 99/537
2009/0145306 A1 * 6/2009 Bearson ..... A22C 17/0033 99/355
2011/0265492 A1 * 11/2011 Newman ..... A23L 3/375 62/1
2013/0074667 A1 * 3/2013 Weber ..... B25J 9/0051 83/73

FOREIGN PATENT DOCUMENTS

DE 102004062393 A1 7/2006
DE 102007036725 A1 * 2/2009 ..... B26D 5/02
DE 102008019776 A1 10/2009
DE 102009024189 A1 12/2010
DE 102010008047 A1 * 8/2011 ..... B26D 1/143
EP 0101264 A2 2/1984
EP 1018411 A2 7/2000
EP 2407285 A2 * 1/2012
JP 04187970 A * 7/1992
WO WO 2006092310 A1 * 9/2006 ..... B26D 7/01
WO WO-2011072187 A2 6/2011

* cited by examiner

FIG. 1
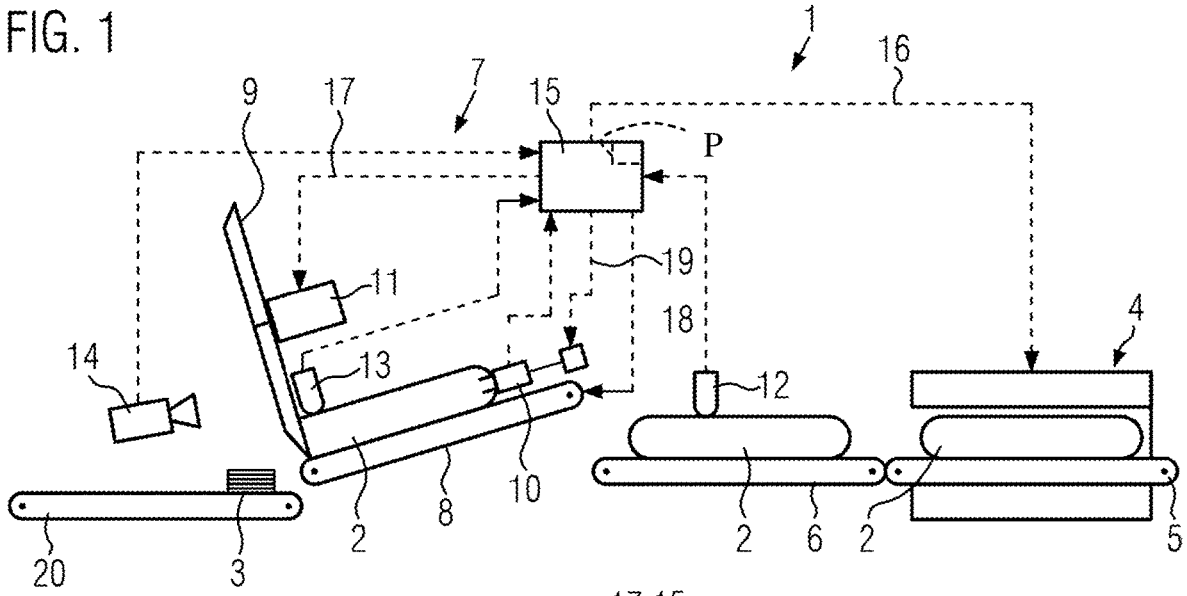
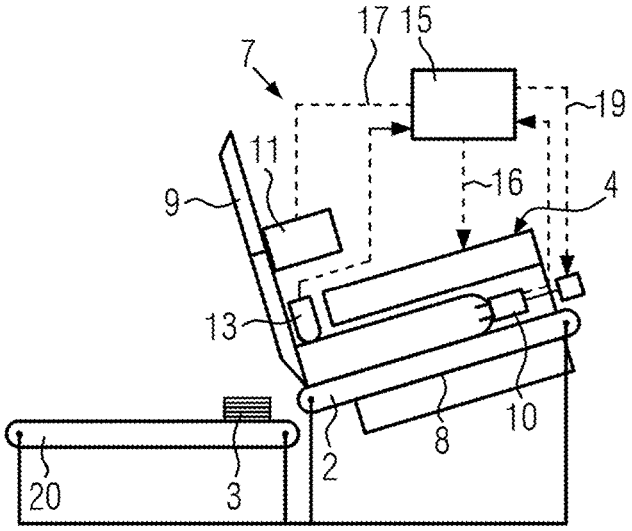
FIG. 2
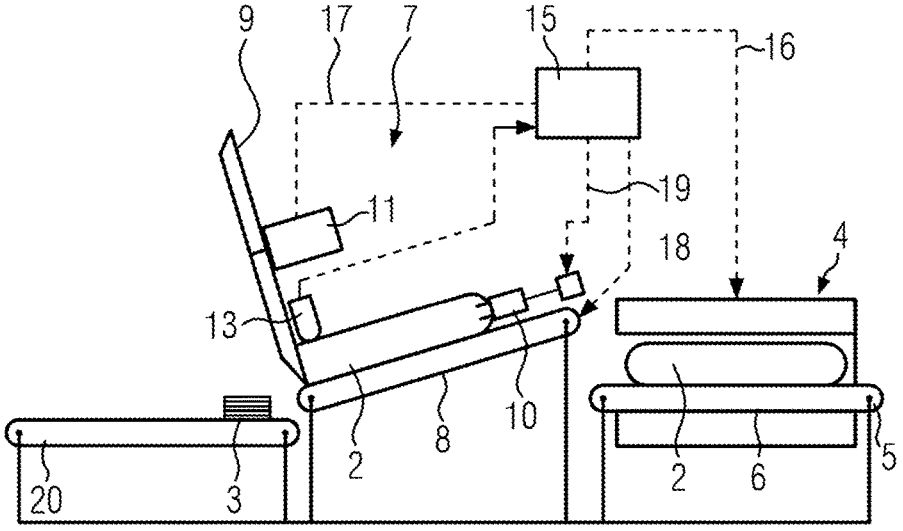
FIG. 3

FOOD SLICING DEVICE WITH PRE-COOLING DEVICE

CROSS-REFERENCE TO RELATED APPLICATION

This application claims priority to German Patent Application No. 102015003632.7 filed on Mar. 19, 2015, which is hereby incorporated by reference in its entirety.

TECHNICAL FIELD

The present disclosure relates to a food slicing device for slicing food products, said food slicing device having a pre-cooling device for cooling the food product before the slicing and a cutting device with a cutting blade. The disclosure furthermore relates to a method for slicing a food product, comprising the pre-cooling of the food product in a pre-cooling device.

BACKGROUND

The food products are in particular food product blocks, such as, for example, sausage blocks, cheese blocks or ham blocks, or naturally formed food products, such as bacon or raw ham, for example.

During the slicing of such products, a lower proportion of free water is striven for in the products. In the state of the art, pre-cooling devices are used in food slicing devices. There the products are strongly cooled or even frozen at least in the edge area shortly before the cutting, for example, in order to optimize the cutting quality in interaction with the cutting blade or in order to reduce the deformation of the product.

For example, in DE 10 2009 024 189 A1 in this category, a cutting device for food products is disclosed, wherein this cutting device has a conditioning device in which a food product, particularly ham, is simultaneously formed into the product and cooled, before the food product is sliced. For this purpose, the pressing surface of the conditioning device is cooled to a regulated temperature.

DE 10 2008 019 776 A1 discloses a cutting device with a product sensor in the form of an infrared camera with which the temperature of a product can be determined Based on this measurement, parameters of the cutting device, such as the rotational speed of the blade, the blade clearance, the feed rate, etc., for example, can be adjusted.

However in the state of the art, fluctuating product textures, such as are found particularly in naturally formed food products, and fluctuating product temperatures often lead to distinct differences in the cutting quality and influence the portion formation, particularly the deposit characteristics at the cutting blade, depending on the food product.

SUMMARY

The object of the present disclosure is consequently to enhance a food slicing device and a method for slicing a food product in such a manner that the most constant level of cutting result quality possible can be achieved in the slicing of food products.

This is achieved by a food slicing device for slicing food products that has a pre-cooling device for cooling the food product before the slicing and a cutting device with a cutting blade, wherein according to the disclosure, a temperature registration device for measuring the temperature of the food product and a control unit are provided, wherein the control unit is designed to calculate, based on the temperature measured by the temperature registration device, an instruction for the operation of the pre-cooling device and wherein the pre-cooling device is controllable depending on this instruction.

By registering the temperature of the food product and calculating an instruction for the operation of the pre-cooling device, it is possible to guarantee that, in spite of fluctuating product textures and product temperatures upstream of the pre-cooling device, an optimal instruction for the operation of the pre-cooling device can be calculated. The food product can consequently be optimally pre-cooled before being fed to the cutting device, and consequently the cutting quality and cutting performance of the cutting device can be standardized and improved.

This applies in particular to inhomogeneous products such as bacon or ham that often have different cutting characteristics under the same basic conditions. One cause for this is different salt and fat levels. For example, the salt level directly influences the freezing behaviour in the surface area of the food product.

The cutting device is in particular a slicer.

Advantageously used as a temperature registration device is at least one temperature sensor. Temperature sensors that are brought into contact with the food product are advantageously to be insulated in such a way that only their front area is free and consequently only the product temperature is registered, and ambient temperature influences are excluded as much as possible.

Advantageously, a plurality of temperature registration devices or sensors can be provided along the transport direction of the food products from the pre-cooling device to the cutting blade, wherein their measured values provide information about the time-temperature behaviour of the food products. The time-temperature behaviour can be evaluated in order to calculate an optimal instruction for the operation of the pre-cooling device. If only an outer layer of a food product has been sufficiently cooled while the interior of the food product is still too warm, this can be seen in the time-temperature behaviour because the outer layer warms rapidly under the influence of the ambient temperature and the internal temperature of the food product. As a countermeasure, the instruction for the operation of the pre-cooling device can be adjusted in such a way that the food product is held in the device longer and consequently the interior is also sufficiently cooled.

The food products are frequently already cooled before being fed to the food slicing device from an upstream buffer storage area. However the temperature in this storage area is usually higher than the desired temperature for the cutting process and cannot be regulated according to the situation, particularly because the temperature of individual food products cannot be adjusted there as needed depending on their characteristics.

The pre-cooling device is advantageously designed to adjust, depending on the instruction, the dwell time or throughput speed of the food product in the pre-cooling device and/or the cooling capacity or pre-definable temperature. It can thereby be ensured that the food product is pre-cooled to the desired temperature depending on the food product's characteristics. The instruction can particularly be a data set that comprises the target temperature in the pre-cooling device and/or the cooling capacity of the pre-cooling device and/or the dwell time or throughput speed of the food product in the pre-cooling device.

In particular, the control unit can be designed to determine the difference between the measured temperature and a pre-definable value for the specific freezing point of the food product. The specific freezing point is a product-dependent value or a characteristic that is stored in the control unit particularly for various products and that can be retrieved from this control unit. In particular, the specific freezing point depends on the composition of the food product, for example, on the specific fat or salt level.

In an embodiment, the pre-cooling device and control unit are designed and connected in such a way that automatic regulation of the pre-cooling device is carried out by the control unit. The temperature registration device, the control unit, and the pre-cooling device advantageously form a control loop. Alternatively, the instruction for the operation of the pre-cooling device is indicated to an operator who then, in the event of an autarkic pre-cooling device that is not directly integrated in terms of the regulation, manually controls the pre-cooling device depending on this instruction.

The calculation of the instruction can in particular be carried out by means of the registration of an average value or limiting value, which results from various sequential measured values for the temperature of the food product.

In an embodiment the temperature registration device is provided downstream of the cutting blade. The temperature registration device is thereby preferably provided close to the cutting device in order to register the surface temperature of the cutting surface of a cut portion of the food product as soon as possible after the cutting process on a portion placement area. Alternatively, the temperature of the cutting surface of the food product can be registered by using a contactless measurement method. Information on the temperature distribution within the food product can consequently be determined.

The temperature registration device can advantageously be contactless, for example, an infrared temperature sensor, particularly an infrared camera, with which thermographic evaluation of the cutting surface or of the food product can be carried out. Furthermore a pyrometer, particularly a laser sensor, can be used for punctual measurements. Alternative temperature registration devices can register the temperature using infrared spectroscopy or ultrasound.

Alternatively, a contact temperature sensor which is provided, for example, on the portion placement area of the cutting device can be used as the temperature registration device.

The temperature registration device can advantageously be arranged between the pre-cooling device and the cutting blade. In this way it is possible to determine the temperature of the food product directly before the slicing.

In particular the temperature registration device can be designed to be pierced into the food product and then removed from it again. The temperature in the interior of the food product can consequently already be determined before the slicing. The piercing into the food product can take place in an axial or radial manner, i.e., starting from the peripheral surface or from an end surface of the food product. In particular, the piercing with the temperature registration device takes place while the food product is being gripped. The piercing is advantageously carried out in the end region of the food product because this area is not further processed and consequently the product is not damaged by the piercing.

The temperature registration device can alternatively or additionally be provided at other locations in the feeding area of the cutting device, for example, in a loading opening or in the area of an upper tractor belt of the product feeding. A provision of the temperature registration device on the gripper seat allows the product to be traversed by the temperature registration device.

In an embodiment, the cutting device has a gripper that is designed to grip the upstream end of the food product at least at the end of the cutting process for a food product, wherein the temperature registration device is provided on the gripper. This is advantageous because the gripper is brought close to the product with each slicing process and even engages in the product and because the gripper is arranged only in the end region of the product in which an invasive measurement of the product also does not cause damage.

In particular, the temperature registration device is provided on a gripper spike or gripper claw of the gripper, wherein the gripper spike or gripper claw is pierced into the food product for gripping.

The temperature registration device can in particular be integrated into the gripper spike. Alternatively, the temperature registration device is assigned to the gripper spike, which means it is arranged on the gripper spike. The temperature registration device can also itself serve as a gripper spike. Moreover it is possible for the temperature registration device to be located in a ready position within a gripper spike and to be driven out of this position when the gripper spike has already been pierced into the food product.

Alternatively or additionally, the temperature registration device can be provided as an additional sensor element on the gripper and it can be movable with respect to the gripper in order to come into contact with the food product or to be pierced into the food product. The temperature registration can consequently take place independently of the position of the gripper spikes. If the temperature registration device only comes into contact with the food product, it is advantageously brought to lie against the surface of the end piece of the food product with a defined force in order to measure the surface temperature there. The temperature registration device can, through its movement relative to the gripper, be pierced into the product in an axial or radial manner. An axial piercing has a movement similar to the movement of an end piece ejector and can be combined with such a unit. The piercing into the food product in the end piece that is gripped by the gripper is unproblematic as far as hygiene and appearance are concerned because the end piece is not utilized.

The temperature registration device on the gripper can comprise a battery or it can be battery operated in order to avoid an electric line. The measurement signal can then be transmitted by radio to an assigned controller.

The measured value can be handed over in an end position of the gripper, which means when the gripper is driven back for the uptake of a new food product, the temperature level of the already-sliced food product is queried or transmitted. This can take place via an electrical contact or by radio to a receiver in the area of the gripper end position.

The provision of the temperature registration device on the gripper makes it possible to determine the surface and/or core temperature of food products that are to be sliced at a time shortly before the cutting. The determined temperature, particularly the core temperature, can be visualized in the control unit and where appropriate be used for the regulation in order to optimize the cutting process or for automatic adjustment of machine parameters and product parameters, for example, by the pre-cooling. Constant quality of the cutting result and a visually better cutting and portion quality can be achieved in this way.

In a preferred embodiment, the control unit has a device-specific and product-specific database whose data are taken into consideration during the calculation of the instruction and/or of pre-definable parameters for the cutting operation. For example, the specific freezing points for various food products can be stored in the product-specific database. Furthermore machine parameters, such as feed rate, cutting blade speed, slice thickness, portion pattern, etc. for the different food products can be stored in the database, where appropriate, depending on various cutting blades. The database furthermore includes data regarding various device parameters, for example, regarding various cutting blades, gripper arrangements, etc. The appropriate data can be taken into consideration during each calculation of the instruction for the pre-cooling device. For example, based on the measured temperature level and depending on the cutting blade in use and the food product that is to be sliced, a suitable instruction for the operation of the pre-cooling device can be determined.

In particular, the control unit can be designed to update the data in the device-specific and product-specific database depending on the temperature measurements and system parameters after a cutting process. Should the measurement results indicate an inadequate cutting result, the suitable instruction for the operation of the pre-cooling device can be adjusted as needed.

The disclosure furthermore provides a method for slicing a food product in which the food product is pre-cooled in a pre-cooling device, wherein the temperature of the food product is measured after the pre-cooling and before or after the slicing of the food product, and the operation of the pre-cooling device is then adjusted depending on the measured temperature of the food product. The temperature of the food product can thereby be optimally adjusted for the slicing and consequently an advantageous cutting result can be achieved.

For slicing the food product, advantageously a cutting device with a cutting blade is used, which means that the slicing is brought about by a slicer.

In an embodiment, the specific freezing point of the product is pre-definable, and the operation of the pre-cooling device is adjusted depending on the difference between the measured temperature and the specific freezing point. By taking the specific freezing point into account, an optimized cutting and portion formation result can be achieved depending on the product type.

The operation of the pre-cooling device can be automatically or manually adjusted. The automatic adjustment corresponds in particular to an automated regulation of the pre-cooling device on the basis of the measured temperature level. Moreover it is possible to regulate the cutting process or a setting of the cutting parameters depending on the measured temperature level.

With manual adjustment of the operation of the pre-cooling device, the instruction with regard to advantageous operation of the pre-cooling device is output on a display as a recommendation, and the operator can then appropriately adjust the operation of the pre-cooling device.

In an embodiment, a surface temperature of the food product can be measured during the measurement of the temperature of the food product. The surface temperature of the food product can be determined at only one position, at a plurality of positions, or along the entire axial extension of the usable area of the food product. In some embodiments the entire edge or surface temperature can be registered for the area, where possible, for example, with the use of infrared cameras. Preferably the measurement takes place in the feeding area or loading area of the cutting device that slices the food product.

In particular, a core temperature of the food product can be measured during the measurement of the temperature of the food product. This can be carried out in addition to or alternatively to the measurement of the surface temperature. The core temperature can be determined, for example, by a temperature registration device that is pierced into the food product where it measures the temperature in the interior before finally being removed again from the food product. A temperature registration device of that kind can be provided on a gripper of the cutting device, wherein the gripper grips, at least temporarily, an end of the food product that is spaced a distance from the cutting blade.

The measurement of the temperature can furthermore be carried out via a texture analysis, by measuring the deformation of the food product by using a deformation probe or by measuring the penetration depth by using a penetration probe. The deformation probe or the penetration probe consequently each constitute a temperature registration device in the form of a mechanical temperature measurement element. The penetration depth of the deformation probe or the deformation of the food product is thereby measured. A component of the conveyor technology present in the cutting device can also serve as a deformation probe, where this can be, for example, a pressure roller, an inspection punch with a pressure roller at the tip, a conveyor belt or a tractor unit, particularly in the feeding area, which presses on the food product with a defined pressure. The deformation probe can furthermore also be a limit stop, wherein the measurement of the deformation takes place in particular between two opposite limit stops. In particular, two parallel side limit stops can be driven together to the food product. Alternatively, a single limit stop can also be provided, out of which a deformation probe is then driven. These mechanical measurement methods are preferably carried out at the end piece of the food product because local, possibly visible pressure marks are irrelevant due to the lack of further processing of the end piece.

A mechanical temperature measurement element can be used as a temperature registration device particularly before or during the peeling process of a food product in a peeling machine. The measurement can thereby be carried out by deformation of the food product before the skin is peeled off in the peeling machine. The deformation measurement can consequently not compromise the food product from a hygiene point of view due to the lack of direct contact. Further measurement points are however likewise advantageous, for example in the area of the feeding and loading of the cutting device or also in the area of one of the scanners placed before the cutting device.

In an embodiment the measurement of the temperature does not take place until at the end of the slicing process or at the end of the dwell time of the food product in the cutting device. The measurement of the temperature thereby takes place close in time to the slicing of the food product, and an interim temperature change of the food product is to be assumed to be minor.

The slicing of the food products advantageously takes place in parallel in a plurality of tracks, wherein the measurement of the temperature is carried out for each track and the measured temperature levels are evaluated together by a control unit. Consequently, in the event of multi-track slicers, a temperature measurement for each individual track can be implemented and the measurement results can be compared to one another or combined to form an average value. A plurality of measured values thereby not only allows the detection of local deviations, but can also be used for error detection, for example, to detect a defective sensor.

In an embodiment the ambient temperature can be measured in parallel. Based on the measured value of the ambient temperature, a plausibility check of the measured temperature levels of the food product can be conducted. In addition or alternatively, the ambient temperature can be incorporated into the calculation of the instruction for the pre-cooling device or it can be taken into consideration for the adjustment of the operation of the pre-cooling device. The measurement of the ambient temperature advantageously takes place through the use of appropriate sensors in the cutting device and in particular on its gripper.

In an embodiment the measured temperature levels at a plurality of measurement times or from a plurality of measurement points on one or more food products are stored and processed and/or evaluated by a control unit. The measured temperature development during the time can be taken into consideration for the adjustment of the operation of the pre-cooling device or for the calculation of the instruction for the pre-cooling device. This means that, for example, the temperature gradient and not only the current temperature level is taken into consideration. The temperature development during the time can furthermore make it possible to draw conclusions about the plausibility of the measurements, so that, for example, defective sensors can be identified. By means of a combination of a plurality of measured temperature levels that have been determined either at various points in time or at various locations or on various food products, it is possible to obtain a more comprehensive idea of the temperature of the food products or regarding the function of the sensors. The measured values can additionally be stored in the device-specific and product-specific database, as a result of which the control unit can take into account information regarding previous pre-cooling and/or cutting processes, which means that it can be designed as an intelligent or "learning" system.

The disclosure furthermore provides a food slicing device for slicing food products that has a cutting device with a cutting blade, and a gripper that grips the end of the food product facing away from the cutting blade at least temporarily, wherein a temperature registration device is provided on the gripper. In particular, the gripper has a gripper spike that is pierced into the food product in order to grip it. The temperature registration device can be integrated into the gripper spike, assigned to the gripper spike, or built onto the gripper spike, e.g., below a curved gripper spike. The temperature registration device can furthermore itself serve as a gripper spike or it can be mounted on the gripper spike as an additional sensor element. This additional sensor element can move in particular axially into the product. The additional sensor element can additionally be mounted radially on the gripper and where appropriate move radially with respect to the gripper. In an embodiment the temperature registration device can be provided within the gripper spike and be driven out of the gripper spike once the gripper spike has been pierced into the food product.

The measured temperature levels registered with the temperature registration device can be stored in the database, in particular for historicization, in order thereby, for example, to carry out a cutting process analysis, to achieve comparability of the product cooling quality, or to allow documentation of the cold chain.

The present disclosure is now explained on the basis of preferred embodiments that are depicted in the following figures.

BRIEF DESCRIPTION OF THE DRAWINGS

FIG. 1 shows an embodiment of a food slicing device according to the disclosure with a pre-cooling device upstream of the cutting device, FIG. 2 shows an embodiment of a food slicing device according to the disclosure with a pre-cooling device integrated in the feeding area of the cutting device, FIG. 3 shows an embodiment of a food slicing device according to the disclosure with a pre-cooling device integrated in the loading area of the cutting device.

DETAILED DESCRIPTION

Figure 4:
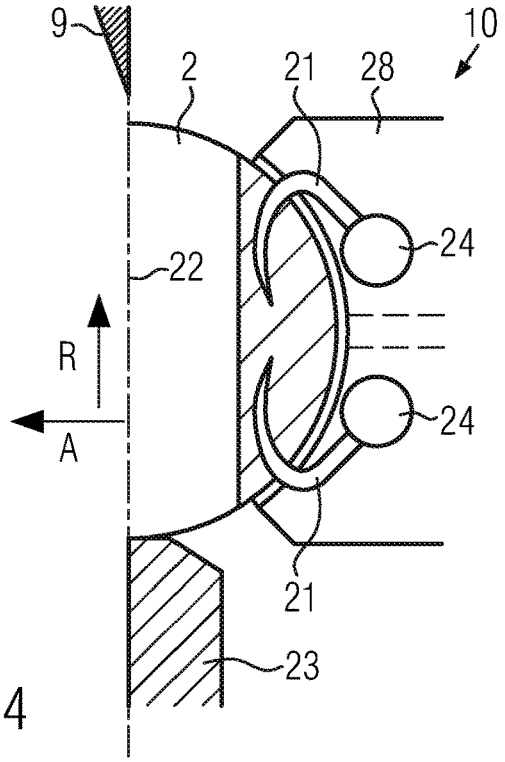
FIG. 4 shows a development of a gripper in a side view.

FIG. 1 depicts a food slicing device 1 according to the disclosure in which the food products 2 are sliced into food portions 3. The food slicing device 1 has, on its upstream end, a pre-cooling device 4 in which the food products 2 are pre-cooled in a controlled way according to an instruction.

The dwell time or the throughput speed of the food product 2 in the pre-cooling device 4 and/or the cooling capacity of the pre-cooling device 4 can be adjusted. In particular, the food products 2 run through the pre-cooling device 4 on a conveyor belt 5.

Provided after the pre-cooling device 4 is a loading conveyor belt 6 that leads from the pre-cooling device 4 to a cutting device 7. The loading conveyor belt 6 can principally be used for transport, but also for buffering of the pre-cooled food products 4.

The cutting device 7 has a feeding conveyor 8 on which the food product 2 is fed to a cutting blade 9. In order to facilitate the feeding movement of the food product 2 to the cutting blade 9, the feeding conveyor 8 is advantageously tilted with respect to the horizontal plane, so that the movement of the food product 2 towards the cutting blade 9 is supported by gravity. The feeding conveyor 8 can be aligned with the loading conveyor belt 6 by a tipping movement in order for it to be possible to pass over the food products 2 from the loading conveyor belt 6 to the feeding conveyor 8.

The feeding conveyor 8 can be a conveyor belt, or alternatively just a passive product support can be provided. Furthermore a gripper 10 can be provided that can grip, at least temporarily during the slicing process, the upstream end of the food product 2 that is facing away from the cutting blade 9. In particular, the gripper 10 can be driven linearly in the feeding direction in order to follow the movement of the food product 2. Furthermore the driveability of the gripper 10 can be actively controlled by a gripper drive, so that the gripper 10 can control or regulate the feed of the food product 2. The cutting blade 9 is in particular a rotating circular blade or sickle blade that is driven by a cutting blade motor 11.

The food slicing device 1 according to FIG. 1 has a plurality of temperature registration devices, namely the temperature sensors 12, 13 and the infrared camera 14. A further temperature sensor, not shown, can be provided in the gripper 10.

The measured values of the temperature registration devices 12, 13, 14 are communicated to a control unit 15 that includes a processor P and that calculates, based on these measured values, an instruction for the operation of the pre-cooling device 4. Preferably this instruction is communicated directly via the control line 16 or a corresponding radio connection to the pre-cooling device, which is consequently automatically regulated. Consequently constant readjustment can be carried out during ongoing operation.

The control unit 15 furthermore has information regarding the machine parameters, for example, feed rate, rotational speed of the cutting blade, blade clearance, etc., and can have a device-specific and product-specific database. Consequently the measured temperature levels can be evaluated depending on the operating mode and the stored parameters. Measured values and parameters from previous cutting processes and/or previous products or product batches can be stored in the database and used as input parameters for initial or basic settings or reference values for subsequent calculations of the instruction for the operation of the pre-cooling device 4 or of the machine parameters.

The temperature registration device 12 makes it possible to register the external temperature of the food product 2 close to the pre-cooling device 4. On the other hand, the temperature registration device 13 makes it possible to register the external temperature of the food product directly before the slicing. By comparing the measured temperature levels of the temperature registration devices 12 and 13, it is also possible to reach conclusions regarding the temperature distribution in the interior of the food product 2. A food product 2 with a relatively inhomogeneous temperature distribution experiences a faster change in temperature on the outer side of the food product 2. This can be determined by the comparison of the measured temperature levels of the temperature registration devices 12 and 13. Should the measured temperature levels differ from one another by more than a predetermined tolerance value, the instruction for the operation of the pre-cooling device 4 can be adjusted. Should the external temperature of the food product 2 increase between the temperature registration devices 12 and 13 by more than a tolerance value, it is possible, for example, to increase the dwell time of the food product 2 in the pre-cooling device 4 while simultaneously reducing the cooling capacity in order to achieve more uniform pre-cooling.

The infrared camera 14 can register the temperature directly on the cutting surface of the food product 2 and consequently provide detailed information about the temperature in the interior of the food product 2. However it must be observed that the influence of the cutting blade 9, particularly the heat generation due to friction, must be kept in mind or, where necessary, calculated out.

Furthermore all measured and adjusted values can be documented and assigned to the affected food products 2 or batches. The stored values can then be available as reference values for later slicing processes. A plausibility check can furthermore be carried out in the background. A system-specific database is consequently used that stores, in addition to the behaviour of the pre-cooling device, also values related to the storage temperatures of the products, the ambient temperatures, the length of the conveyor path and the conveyor speeds, all of which have a significant influence on the product temperature in the cutting area, and that can therefore be taken into consideration in the calculation of the instruction.

The calculated instruction for the operation of the pre-cooling device 4 can be indicated to an operator on a display as a suggestion. The operator then manually adjusts the instruction of the pre-cooling device 4. This makes it possible for the instruction to be changed where necessary while keeping in tune with the operator's experience.

The operator can also alternatively be given the possibility to change the displayed instruction in the control unit and then to acknowledge or release the same. After the release of the instruction, this is then automatically communicated to the pre-cooling device 4 via the control line 16.

The instruction indicates the cooling effect on the food products 2 in the pre-cooling device 4. In particular, the pre-cooling device 4 can be temperature-adjustable, i.e., the pre-cooling device 4 is given a desired temperature that is then reached or maintained via the regulation of the cooling capacity in a control loop provided in the pre-cooling device 4. The instruction for the cooling effect on the food products 2 can be implemented by using this pre-definable temperature or by direct access to the regulation of the cooling capacity. Additionally or alternatively, the instruction for the cooling effect can be implemented by adjusting the throughput and/or dwell time.

The control unit 15 furthermore has a control line 17 to the cutting blade motor 11, a control line 18 to the drive of the feeding conveyor 8 and a control line 19 to the gripper 10. The control unit 15 can consequently control the machine parameters of the cutting device, namely in particular the speed of the cutting blade 9, the feed rate of the food product 2, the blade clearance and the engagement of the gripper 10.

The slices of the food product 2 sliced off by the cutting blade fall onto a portion placement area 20, where they form the portion 3. The portion placement area 20 can be developed as a delivery belt conveyor that allows the portions 3 to be transported away. The portion placement area 20 can be driven by the control unit 15 during the cutting process in order to deposit the various slices on to the portion placement area 20 according to a desired portion arrangement.

The control unit 15 is designed to register interruptions in operation, such as batch changes, maintenance, adjustment and cleaning, and to adjust the operation of the food slicing device and particularly the pre-cooling device accordingly. If a food product 2, for example, due to a disturbance in the slicing procedure, remains in the pre-cooling device for a longer time, the cooling capacity or the temperature in the pre-cooling device can be adjusted so that the temperature of the food product 2 remains in the target range. Should the temperature of the food product 2 determined by the temperature registration device 12, 13, 14 nevertheless fail to be in the target range after the pre-cooling device 4, the control instructions for the cutting process, which means particularly the blade speed and feed rate, can be adjusted in order nevertheless to achieve an advantageous cutting result.

FIG. 2 depicts a further embodiment of a food slicing device according to the disclosure. In this embodiment the pre-cooling device 4 is arranged in the area of the feeding conveyor 8, which means very close to the cutting blade 9. The temperature sensor 13 is arranged between the pre-cooling device 4 and the cutting blade 9, directly before the cutting blade 9. A temperature registration device is moreover provided in the gripper 10. The temperature registration device in the gripper 10 allows a measurement on the upstream end of the food product 2. The gripper 10 engages into the food product 2 during the cutting process. The measurement is advantageously carried out relatively late, however, because then there is sufficient time for the heat transfer from the food product 2 to the temperature registration device on the gripper 10.

On the basis of the measured value of the temperature sensor 13 and the temperature registration device in the gripper 10, among others, the control unit 15 calculates an instruction for the operation of the pre-cooling device 4 and communicates this instruction to the pre-cooling device 4 via the control line 16. Otherwise the control unit 15 is in turn designed to control the cutting blade motor 11 via the control line 17 and the gripper 10 via the control line 19.

FIG. 3 shows a further development of a food slicing device 1 according to the disclosure, wherein here the pre-cooling device 4 is arranged in the area of the loading conveyor belt 6. The loading conveyor belt 6 is provided upstream of the feeding conveyor 8. In FIG. 3 it is arranged before the feeding conveyor 8. However it is alternatively possible for the loading conveyor belt 6 to be arranged parallel and next to the feeding conveyor 8, and for the food products 2 to be slid in a lateral direction from the loading conveyor 6 onto the feeding conveyor 8.

In the embodiment according to FIG. 3, only one temperature sensor 13 is provided, and it is arranged directly before the cutting blade 9. A punctual temperature measurement is thereby possible directly before the slicing, as a result of which heating of the food product 2 after the pre-cooling device 4 can be taken into consideration. For the calculation of the instruction for the operation of the pre-cooling device 4, in particular a measured value towards the end of the cutting process should be used. This makes it possible to take into consideration the heating of the food product 2 in the feeding area of the cutting device 7 during the slicing. This means a temperature measurement is carried out on the back end of the food product 2.

The control unit 15 in turn calculates, from the temperature level measured by the temperature registration device 13 and where appropriate other quantities or parameters, an instruction for the operation of the pre-cooling device 4 that can be communicated to the pre-cooling device 4 via the control line 16.

In all embodiments, the control unit 15 can be designed to store the product-specific temperature change rate in a database as a parameter and to allow it to influence the calculation of the instruction for the pre-cooling device 4. The temperature change rate can particularly be determined by temperature measurements at various locations, namely in particular by various temperature registration devices 12, 13, 14 or by temperature measurements at various points in time. The temperature change rate depends not only on the temperature distribution in the food product 2, but also on the ambient temperature which can consequently be measured, and on the product type, whose characteristics are stored as a data set in the database for this reason. The control unit 15 can more precisely calculate the instruction for the pre-cooling device 4 while taking into consideration the ambient temperature and the characteristics of the particular product type.

The method according to the disclosure can also be carried out with the food slicing devices 1 depicted in FIGS. 1 to 3. In a preferred embodiment, in the case of this method first the specific freezing point for the product type of the food product 2 that is to be sliced is read out of a database. Then using one or more temperature registration devices 12, 13, 14 a temperature level of the food product 2 is determined. The temperature level is evaluated by determining the difference between the measured temperature levels and the specific freezing point. This difference serves as a control criterion or as a direct control variable and can, as an instruction for the operation of the pre-cooling device 4, either be automatically communicated to the pre-cooling device 4 or be suggested to an operator, who then approves the instruction or adjusts the operation of the pre-cooling device 4 on the basis of this instruction. Moreover, in the method according to the disclosure, the edge and cutting parameters of the cutting device and other corresponding system components can be adjusted while taking into consideration the parameters stored in the machine controller.

In particular, the measured values from previous cutting processes and/or from previous food products 2 or product batches can be stored in a database, wherein these values are accessed again when the same or similar conditions or food products 2 are present. Then these parameters can be used for the initial or basic setting of the food slicing device 1 and in particular by its pre-cooling device 4. The stored parameters can consequently be used as reference values for the subsequent food products 2.

Shown in a side-view in FIG. 4 is a gripper 10 whose gripper spikes 21 engage in an end piece of a food product 2. Furthermore depicted in FIG. 4 is the cutting blade 9 arranged in the cutting plane 22 and a cutting edge 23 that is located on the front end of the feeding conveyor 8. The gripper spikes 21 can be pivoted with respect to a gripper spike joint 24 in order to be pierced into the end piece of the food product 2 essentially in the radial direction R and to be driven out of the same again.

Figure 5:
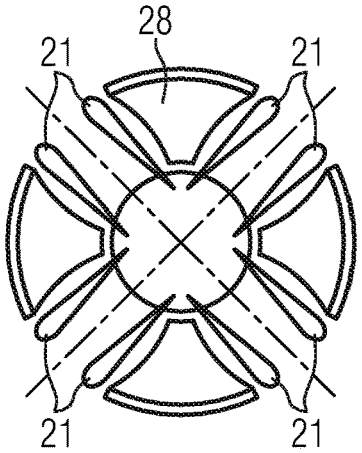
FIG. 5 shows a development of a gripper in a front view.

As can be seen in FIG. 5, a total of eight gripper spikes are provided, with four sets of two that are jointly held in a gripper spike joint 24.

Figure 6:
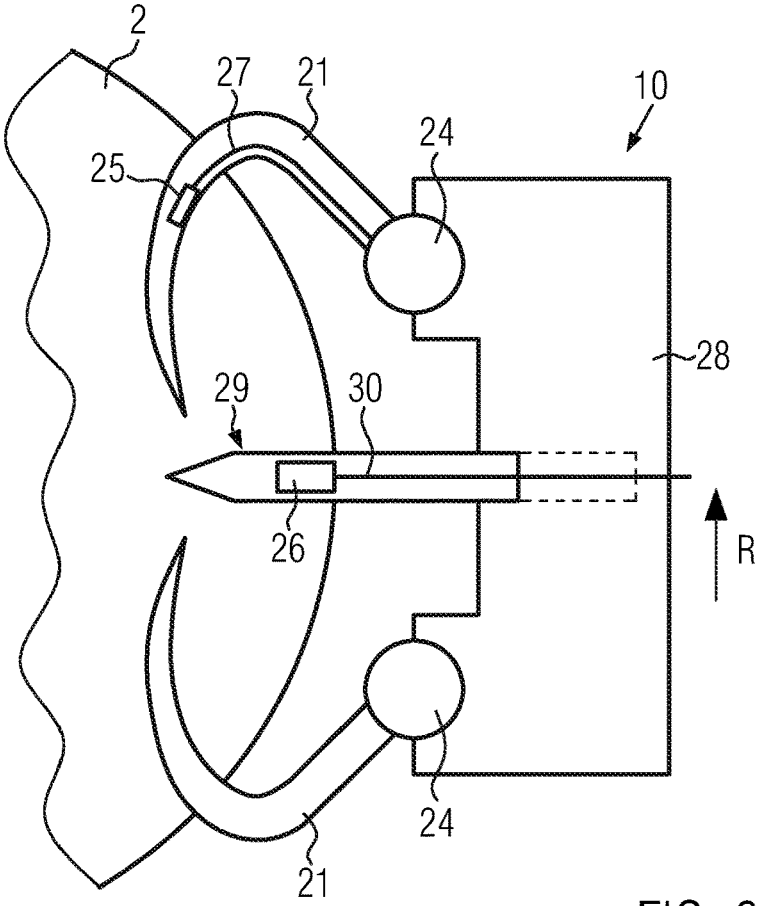
FIG. 6 shows a development of a gripper that is provided with a temperature registration device.

In FIG. 6, two possible arrangements of temperature registration devices 25, 26 on the gripper 10 are shown. The temperature registration device 25 is provided directly on the gripper spike 21, particularly in the front area of the gripper spike 21. The temperature registration device 25 is a contact temperature sensor that can be provided in a depression in the gripper spike 21. Extending from the temperature sensor 25 is an electric line 27 with which the measured temperature level can be communicated first to the main gripper body 28 and then to the control unit 15. Alternatively the temperature registration device 25 or the main gripper body 28 can also be provided with a radio module with which the measured temperature level can be transmitted by radio.

Provided on the main gripper body 28 is a sensor element 29 that can be driven out in the axial direction A and that has the temperature registration device 26 on its front end. The sensor element 29 is pointed on its front end so that it can penetrate into the end piece of the food product 2 when driven out of the main gripper body 28. When the sensor element 29 is in its extended position as shown in FIG. 6, the temperature registration device 26 is arranged in the interior of the end piece of the food product 2 and can measure the temperature there. The measured temperature levels can be communicated to the main gripper body 28 via an electric line 30 and then to the control unit 15. Transmission by radio is alternatively also possible here.

Figure 7:
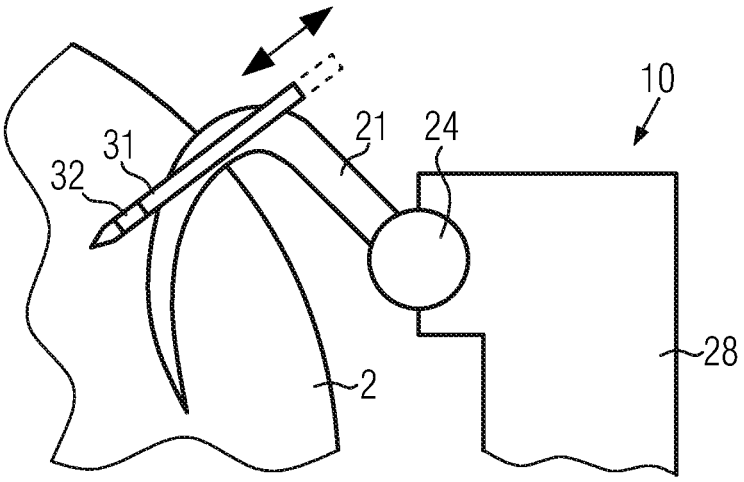
FIG. 7 shows a development of a gripper whose gripper spike is provided with a temperature registration device.

Depicted in FIG. 7 is a development of a gripper 10 in whose gripper spike 21 is arranged a linearly displaceable sensor element 31. In its front area, the sensor element 31 has a temperature registration device 32. During the piercing of the gripper spike 21 into the food product 2, the sensor element 31 is in its driven-back position, shown with the dashed lines. As soon as the gripper spike 21 is arranged in the food product 2, the sensor element 31 is driven by a positioning element, particularly by a pneumatic cylinder, linear motor or servo motor, out into the front position depicted in FIG. 7, so that the temperature registration device 32 is arranged outside of the gripper spike 21 and within the food product 2. The temperature measurement is then carried out, wherein the measured temperature level is in turn communicated to the control unit 15 by an electric line (not shown) or via a radio connection.

Figure 8:
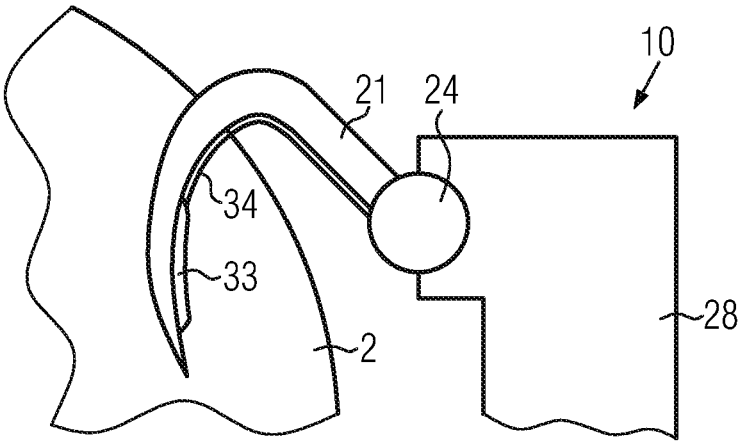
FIG. 8 shows a development of a gripper wherein a temperature registration device is mounted on the gripper spike.

Depicted in FIG. 8 is a variant of a gripper 10 with a temperature registration device 33 that is arranged on the gripper spike 21. The temperature registration device 33 is in particular arranged on the side of the gripper spike 21 that faces the main gripper body 28 in the closed position. Provided going out from the temperature registration device 33 is an electric line 34 that communicates the temperature level of the temperature registration device 33 first to the main gripper body 28 and then to the control unit 15. Alternatively, transmission by radio is provided.

The advantage of the use, according to the disclosure, of temperature registration devices and the consideration of their measured values during the operation of a pre-cooling device is in particular that not only the machine parameters of the cutting device can be adjusted depending on at least one characteristic of the food product, but also that improved pre-cooling of the food product is achieved. The cutting device is consequently fed optimally pre-cooled food products that can be better sliced. In this way, an improved cutting result, an increase in portion quality and consequently a better product yield are achieved. The portions demonstrate a consistent quality with respect to the cutting result that is reflected in particular in a visually improved cutting quality. Moreover, due to the calculation of the pre-specified value for the pre-cooling device, it is possible to avoid operator errors because the regulation is either carried out automatically or clear pre-specified values are indicated to the operator. This allows reliable operation control.

The invention claimed is:

1. A food slicing device for slicing food products, comprising:

a pre-cooling device configured to cool a food product;

a cutting device with a cutting blade positioned to slice the food product after the food product has been cooled by the pre-cooling device;

at least one temperature registration device to measure temperature of the food product at a plurality of measurement times or at a plurality of measurement points; and a control unit including a processor, wherein the control unit is configured to determine the difference between a temperature measured with the at least one temperature registration device and a pre-definable value for a specific freezing point of the food product, and configured to calculate an instruction for operation of the pre-cooling device based on the difference and based on a temperature change rate determined from multiple temperatures measured by the at least one temperature registration device;

wherein the pre-cooling device is controllable based on the instruction, and the pre-cooling device is configured to adjust a dwell time or a throughput speed of the food product in the pre-cooling device depending on the instruction.

2. The food slicing device according to claim 1, wherein the pre-cooling device is further configured to adjust a cooling capacity depending on the instruction.

3. The food slicing device according to claim 1, wherein the pre-cooling device and control unit are configured and connected in such a manner to provide automatic regulation of the pre-cooling device by the control unit.

4. The food slicing device according to claim 1, wherein the at least one temperature registration device is positioned to measure temperature of the food product after the food product has been sliced by the cutting blade.

5. The food slicing device according to claim 1, wherein the at least one temperature registration device is provided between the pre-cooling device and the cutting blade.

6. The food slicing device according to claim 1, wherein the at least one temperature registration device is configured to be pierced into the food product and then removed from the food product.

7. The food slicing device according to claim 1, wherein the cutting device has a gripper that is configured to grip an upstream end of the food product at least at an end of a slicing process, and wherein the at least one temperature registration device is provided on the gripper.

8. The food slicing device according to claim 7, wherein the at least one temperature registration device is provided on a gripper spike of the gripper, the gripper spike being configured to pierce into the food product for gripping.

9. The food slicing device according to claim 7, wherein the at least one temperature registration device is provided as an additional sensor element on the gripper, and is movable with respect to the gripper in order to make contact with the food product or to be pierced into the food product.

10. The food slicing device according to claim 1, wherein the control unit has a device-specific and product-specific database having data that is taken into consideration when calculating the instruction and/or pre-definable parameters for a cutting operation.

11. A food slicing device for slicing food products, comprising:

a pre-cooling device configured to cool a food product;

a cutting device with a cutting blade positioned to slice the food product after the food product has been cooled by the pre-cooling device;

a at least one temperature registration device to measure temperature of the food product at a plurality of measurement times or at a plurality of measurement points; and a control unit including a processor, wherein the control unit is configured to determine the difference between a measured temperature and a pre-definable value for a specific freezing point of the food product, and configured to calculate an instruction for operation of the pre-cooling device taking into consideration 1) the difference and 2) a temperature gradient determined form multiple temperatures measured by the at least one temperature registration device;

wherein the pre-cooling device is configured to adjust a dwell time or a throughput speed of the food product in the pre-cooling device depending on the instruction.

12. The food slicing device according to claim 11 wherein the pre-cooling device is further configured to adjust a cooling capacity depending on the instruction.

13. The food slicing device according to claim 11 wherein the at least one temperature registration device is positioned to measure temperature of the food product after the food product has been sliced by the cutting blade.

14. The food slicing device according to claim 11 wherein the at least one temperature registration device is provided between the pre-cooling device and the cutting blade.

15. The food slicing device according to claim 11 wherein the cutting device has a gripper to grip an upstream end of the food product at least at an end of a slicing process, and wherein the at least one temperature registration device is provided on the gripper.

16. The food slicing device according to claim 15 wherein the at least one temperature registration device is provided on a gripper spike of the gripper, the gripper spike being configured to pierce into the food product for gripping.

17. The food slicing device according to claim 15 wherein the at least one temperature registration device is provided as an additional sensor element on the gripper, and is movable with respect to the gripper in order to make contact with the food product or to be pierced into the food product.

18. The food slicing device according to claim 11 wherein the control unit has a database in which the pre-definable value for the specific freezing point of the food product is stored.

19. A food slicing device for slicing food products, comprising:

a pre-cooling device configured to cool a food product;

a cutting device with a cutting blade positioned to slice the food product after the food product has been cooled by the pre-cooling device;

a temperature registration device to measure temperature of the food product at a plurality of measurement times or at a plurality of measurement points; and a control unit including a processor, wherein the control unit is configured to determine a temperature gradient from the measured temperatures and calculate an instruction for operation of the pre-cooling device taking into consideration the temperature gradient.

20. The food slicing device according to claim 19 wherein the pre-cooling device is configured to adjust a dwell time or a throughput speed of the food product in the pre-cooling device depending on the instruction.

* * * * *